US006155934A

United States Patent [19]

Pinns

[11] Patent Number: 6,155,934

[45] Date of Patent: Dec. 5, 2000

[54] GOLF PUTTER

[76] Inventor: Gary Pinns, 1515 Blackburn St., Wheaton, Ill. 60187

[21] Appl. No.: 09/203,537

[22] Filed: Dec. 2, 1998

[51] Int. Cl.[7] ..... A63B 53/04

[52] U.S. Cl. ..... 473/340; 473/292

[58] Field of Search ..... 473/313, 340, 473/341, 342, 251, 292, 349

[56] References Cited

U.S. PATENT DOCUMENTS

| | | | |
|---|---|---|---|
| 5,322,285 | 6/1994 | Turner | 473/340 |
| 5,344,149 | 9/1994 | Miller | 473/340 |
| 5,377,987 | 1/1995 | Irvin, Jr. | 473/340 |
| 5,575,472 | 11/1996 | Magerman et al. | 473/342 X |
| 5,816,930 | 10/1998 | Brown | 473/254 |
| 5,971,865 | 10/1999 | Shenoha et al. | 473/316 |

*Primary Examiner*—Kien T. Nguyen
*Attorney, Agent, or Firm*—Wood, Phillips, VanSanten, Clark & Mortimer

[57] ABSTRACT

A club for putting a golf ball. In one form, the club has a head with a ground engaging surface and a ball striking surface and an elongate shaft which is connected to the head and holdable by a user at a location remote from the head to permit manipulation of the head to perform a putt. The ball striking surface extends upwardly from the ground engaging surface a predetermined distance that is no more than 0.8 inches. The elongate shaft has a frequency of no more than 275.

20 Claims, 3 Drawing Sheets

GOLF PUTTER

BACKGROUND OF THE INVENTION

1. Field of the Invention

This invention relates to golf equipment and, more particularly, to a golf club used for putting.

2. Background Art

One of the most challenging sports, if not the most challenging sport, is the game of golf. Those in the golfing industry are constantly experimenting with new equipment design to improve play. One of the most demanding aspects of the golf game is putting. This is particularly true in the professional ranks where a modicum of improvement in putting can bridge the gap between failure and success. The golfing audience has been inundated with different putter designs. These designs range from novelty items to those precisely engineered to attempt to meet the demands of professional golfers. While many putters may be saleable because a user is psychologically convinced that their putting is improved with a particular design, the industry constantly seeks out putter designs that actually have better ball striking characteristics.

SUMMARY OF THE INVENTION

The invention is directed to a club for putting a golf ball. In one form, the club has a head with a ground engaging surface and a ball striking surface and an elongate shaft which is connected to the bead and holdable by a user at a location remote from the head to permit manipulation of the head to perform a putt. The ball striking surface extends upwardly from the ground engaging surface a predetermined distance that is no more than 0.8 inches. The elongate shaft has a frequency of no more than 275.

The head has a toe and a heel. In one form the predetermined distance is measured at a horizontal center substantially midway between the toe and heel. The predetermined distance may be measured at the percussion center.

The head may be made from carbon steel.

In one form, the head has a body made from a first material which defines a first part of the ball striking surface and there is a second material which defines a second part of the ball striking surface.

The second material may be, for example, aluminum or copper.

The second material may define the ball striking surface at the percussion center.

The club may have a grip attached to the elongate shaft, with the grip having a top and bottom, with the elongate shaft having a diameter adjacent the bottom of the grip that is not more than 0.51 inches.

In one form, the head connects to the elongate shaft at a first location and the elongate shaft has a diameter adjacent to the first location that is no more than 0.35 inches.

The ground engaging surface may be convex between the toe and the heel.

The ground engaging surface may be substantially flat between the leading end and trailing end of the head.

The head is moved in a forward direction in a putting line to cause the ball striking surface to contact and advance a golf ball. In one form, the head has a substantially straight edge projecting forwardly in the putting line from the ball striking surface and a distance between the head edge and horizontal center between the toe and heel, as viewed from above the head, is substantially equal to one-half the radius of the golf ball. The user of the putter can, from a vantage point above the head, frame the golf ball being putted with the head edge to align the center of the golf ball with the horizontal center of the bead.

The elongate edge may be situated to allow alignment of the center of the golf ball with the percussion center of the head.

The club may have a shaft angle of approximately 0°.

The head may have a loft that is greater than 0°.

The invention is also directed to a club for putting a golf ball, which club has a head having a ground engaging surface and a ball striking surface and an elongate shaft which is connected to the head and holdable by a user at a location remote from the head to permit manipulation of the head to perform a putt. The ball striking surface extends upwardly from the ground engaging surface a predetermined distance that is no more than 0.8 inches. The head has a percussion center and the predetermined distance is measured at the percussion center.

The invention is also directed to a club head for putting a golf ball, which club head has a body with a ground engaging surface and a ball striking surface. The ball striking surface extends upwardly from the ground engaging surface a predetermined distance that is not more 0.8 inches.

The predetermined distance is measured from one of the horizontal center between the toe and heel and the percussion center.

The head may have a visible mark thereon to locate the percussion center for a user.

DETAILED DESCRIPTION OF THE DRAWINGS

Figure 1:
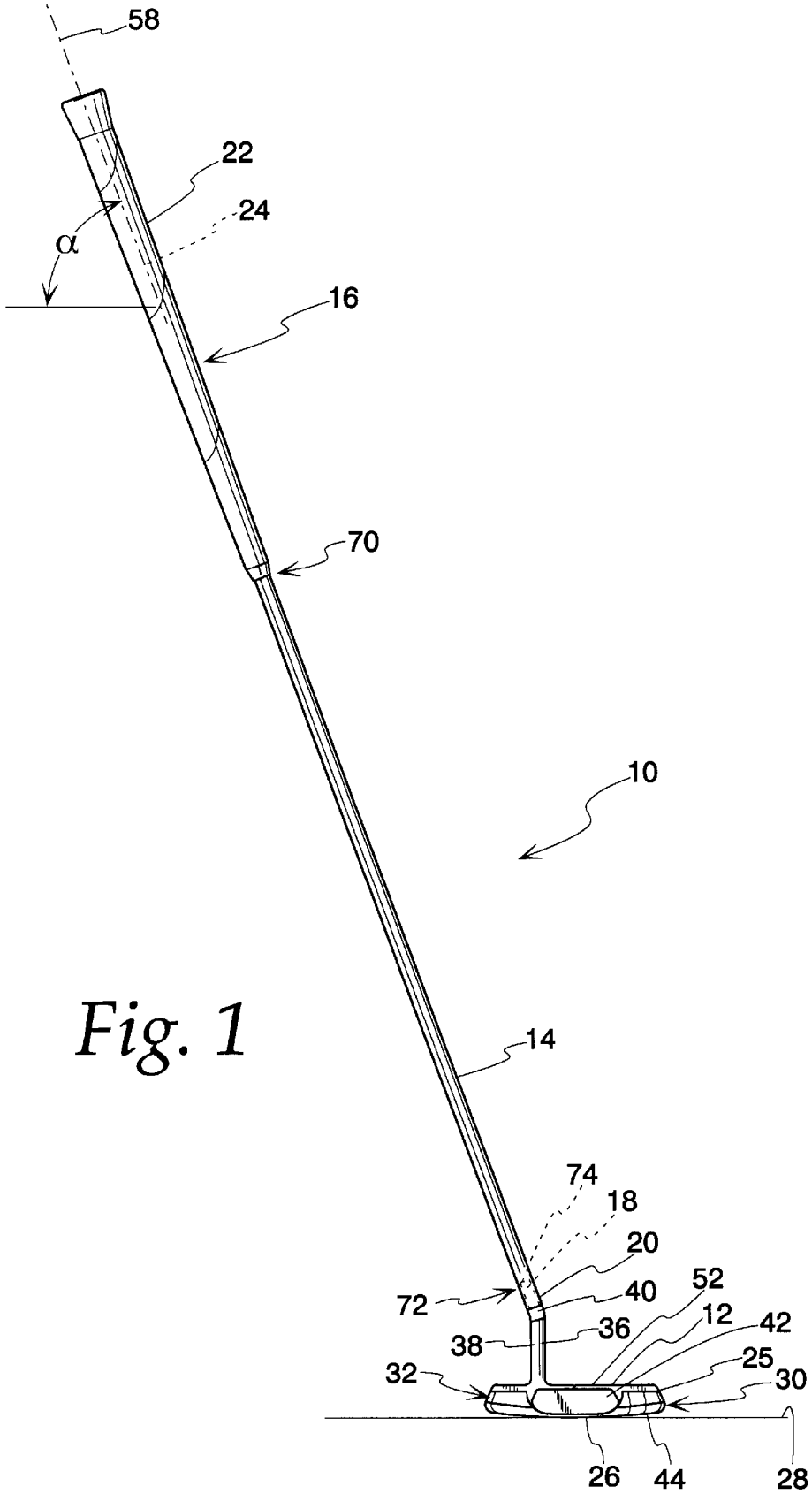
FIG. 1 is a side elevation view of a club for putting a golf ball, according to the present invention.
Figure 3:
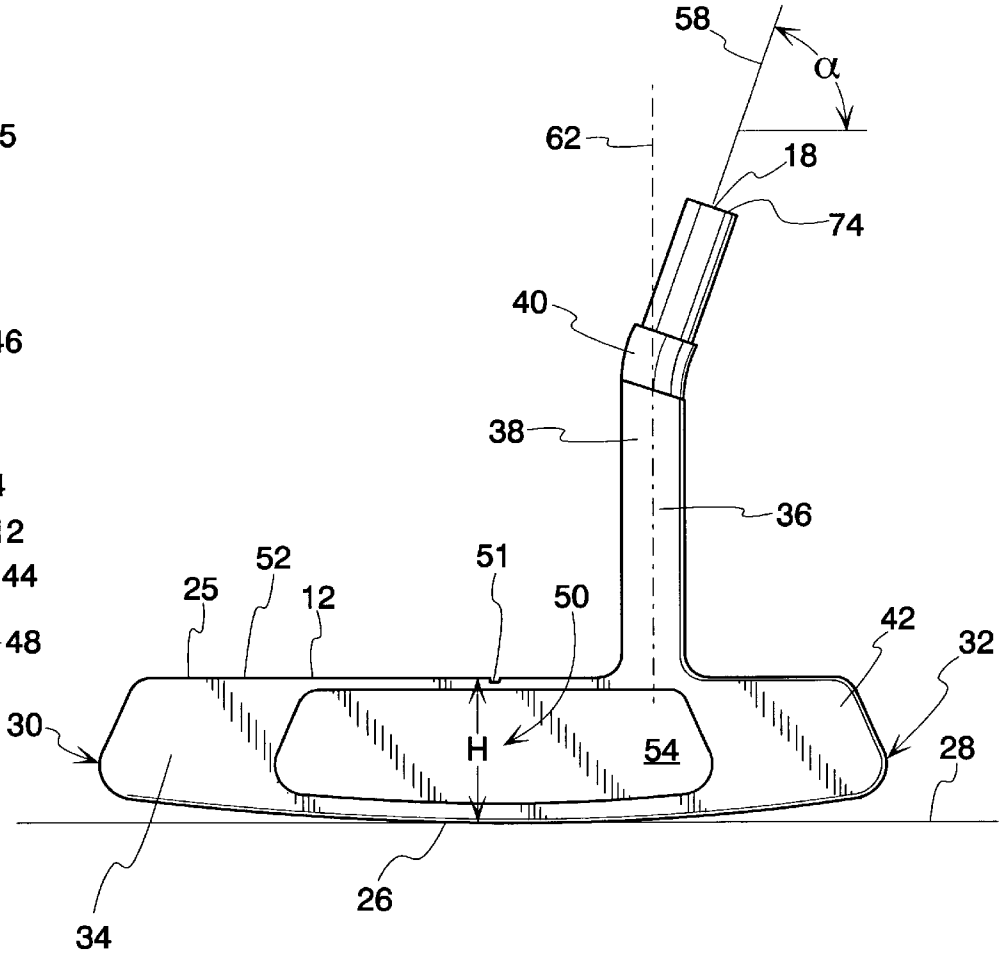
FIG. 3 is an enlarged, front elevation view of the head in FIG. 2.
Figure 2:
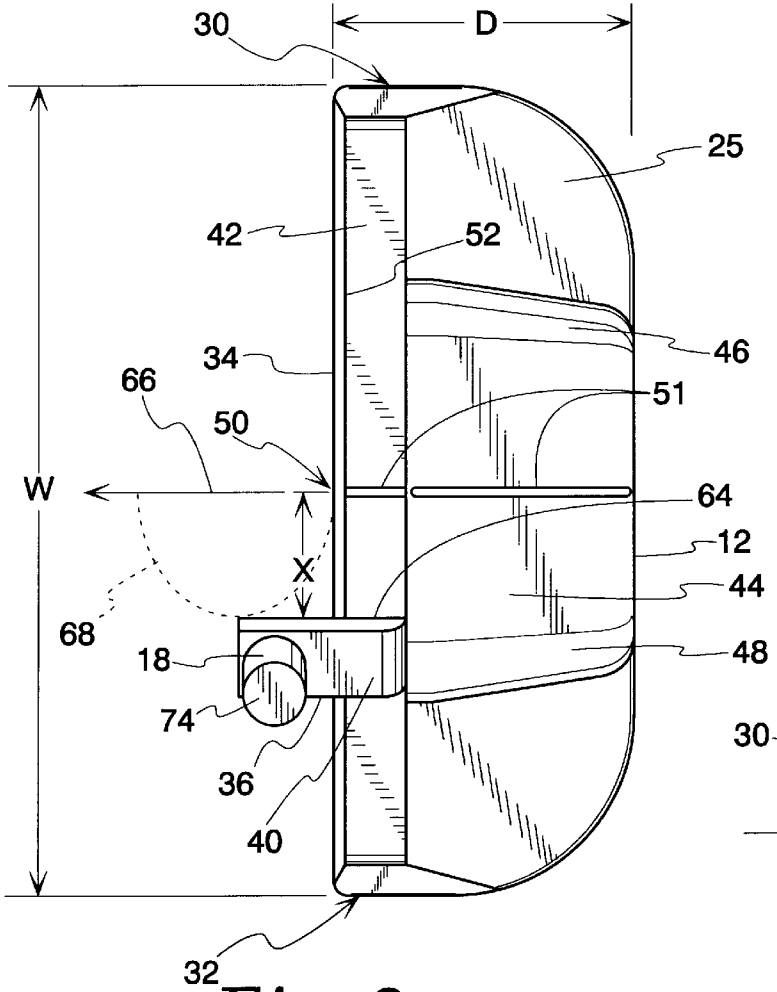
FIG. 2 is an enlarged, plan view of a head on the club in FIG. 1.
Figure 5:
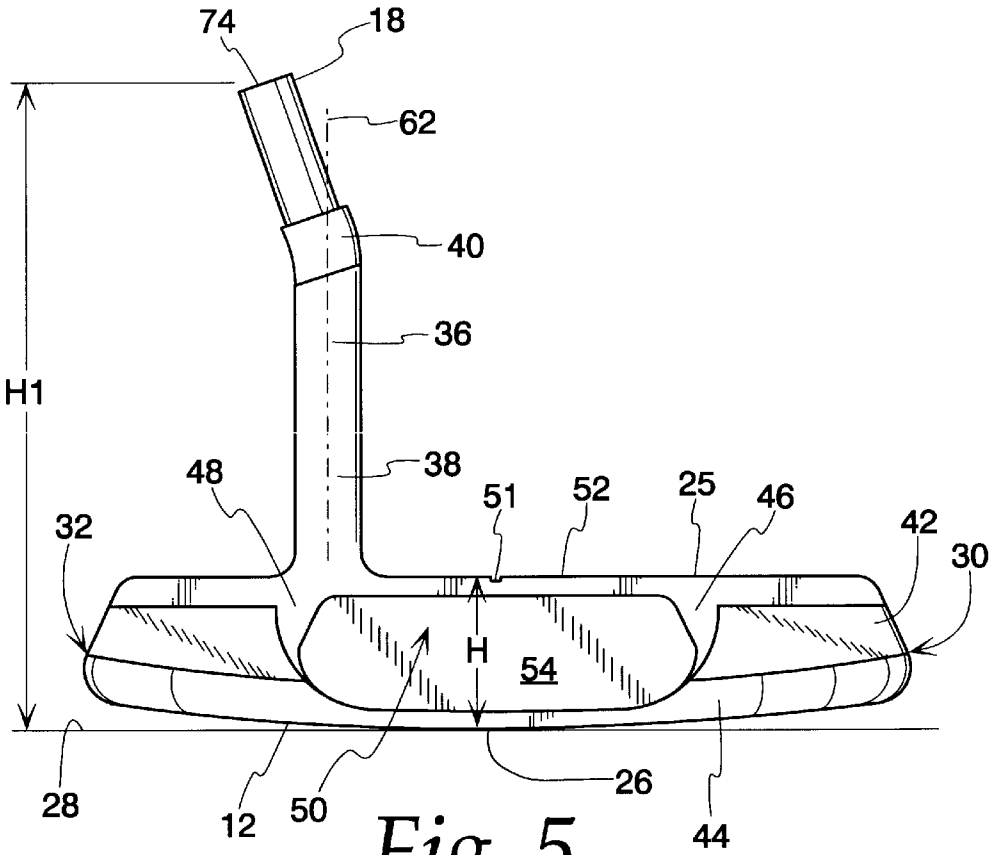
FIG. 5 is an enlarged, rear elevation view of the head in FIGS. 2–4.
Figure 4:
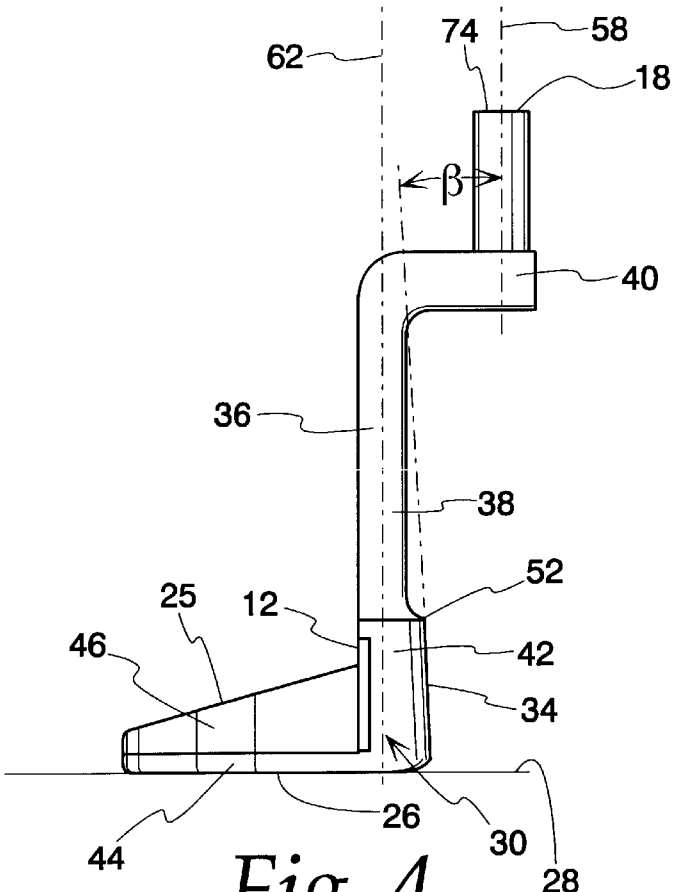
FIG. 4 is an enlarged, side elevation view of the head in FIGS. 2 and 3.

A preferred form of club for putting a golf ball, according to the present invention, is shown at 10 in FIG. 1. As seen also in FIGS. 2–5, the club 10 consists of a head 12 and an elongate shaft 14 which is connected to the head 12, and holdable at a gripping portion 16 at a location remote from the head 12, to permit manipulation of the head 12 to perform a putt. The head 12 has a stub shaft 18 which slides within the lower end 20 of the elongate shaft 14 and is affixed thereto as by an adhesive. A cushion-type grip 22 surrounds the upper end 24 of the elongate shaft 14 and may be a wrapped material or a formed sleeve which is adhered to the elongate shaft 14.

The head 12 has a body 25 defining a ground engaging surface 26 which supports the club 10 on an underlying putting surface 28. The club 10 is shown in a putting position in FIGS. 1 and 3-5 with the head 12 bearing on the underlying putting surface 28.

The head 12 has a toe 30 and heel 32. A ball striking surface 34 is defined at the leading end of the head 12. The head 12 has an L-shaped neck 36 with a vertical leg 38 and a horizontal leg 40 from which the stub shaft 18 projects upwardly.

The head 12 has a vertically extending wall 42 defining the ball striking surface 34, which blends rearwardly into a horizontally extending wall 44 which defines the ground engaging surface 26. Gussets 46, 48 reinforce between the walls 42, 44 and frame the optimum ball striking region 50 on the ball striking surface 34 between the toe 30 and heel 32. The optimum striking location is at a percussion center for the head 12, commonly identified as the "sweet spot". In this case, the percussion center and horizontal center, with the latter being midway between the toe 30 and heel 32, are the same. A mark 51 identifies the percussion center/horizontal center between the toe 30 and heel 32 for the user.

Through extensive testing, the inventor has developed specifications for the club 10 which account for excellent ball striking characteristics. Ideally, the height (H) for the ball striking surface 34 between the grounding engaging surface 26 and top 52 of the ball striking surface 34 is no greater than 0.8 inches. Preferably, this predetermined dimension is maintained at the percussion center, and in this case also at the horizontal center between the toe 30 and heel 32, as identified by the mark 51. The height (H) may be as low as 0.5 inches without adversely affecting performance.

The flex of the elongate shaft 14 contributes likewise to the excellent ball striking characteristics of the club 10. In a preferred form, the shaft frequency is less than 275. Shaft frequency is the number of oscillations per minute for a shaft which is sprung from a constant amount of bend or a certain distance. This measurement is commonly used in the industry because of its accuracy in defining the precise position of the shaft's flex range to identify class. Through testing, it has been determined that the shaft frequency can go as low as 220 without severely compromising club performance.

The preferred shaft construction can be defined in terms of shaft deflection. This measurement is taken with a weight hung over the end of a club that is held horizontally with a constant bending point. The Maltby Shaft Deflection Board has been an industry standard for years. The preferred shaft deflection for the club 10 is a flex of at least 4.5 at 33 inches on the Maltby Shaft Deflection Board.

Models have been made from a solid block of soft carbon steel, which accounts for soft yet solid contact with the ball. An insert 54 is used and defines the optimal striking area on the ball striking surface 34. The remainder of the ball striking surface 34 is defined by the carbon steel. The insert 54 has been made from soft 6061 aircraft aluminum and tellurium copper to dampen the impact on the ball. The insert 54 softens the feel of impact and aids in controlling the distance of putts.

Other characteristics of the club which are intended to be used for a commercial version thereof are described below. The head 12 shown has been made with a distance (W) between the toe 30 and heel 32 that is on the order of 4.463 inches. The head 12 has a dimension (D) between the leading and trailing ends that is on the order of 1.63 inches. The overall height (H1) of the head 12 between the ground engaging surface 26 and the top of the stub shaft 18 is on the order of 3.447 inches.

The ground engaging surface 26 has a convex shape between the toe 30 and heel 32. The ground engaging surface 26 is substantially flat between the leading and trailing ends of the head 12.

The shaft angle for the elongate shaft 14, which is the measurement between the lengthwise axis 58 of the elongate shaft 14 and the ground engaging surface 28, is approximately 0°.

The ball striking surface 34 is substantially flat. The loft angle $\beta$, between the shaft axis 58 and a plane containing the ball striking surface 34, is greater than 0°, and preferably on the order of 5° or less.

The angle $\alpha$ between the axis 58 and the putting surface 28, with the club 10 in the putting position, may be varied based on user preference. The angle $\alpha$ shown is on the order of 70°.

A vertical axis 62 through the center of the leg 38 on the neck 36 is substantially orthogonal to the surface 28 with the club 10 in the putting position.

The leg 40 of the neck 36 defines a substantially straight edge 64 which projects forwardly from the ball striking surface 34 substantially parallel to a putting line identified by the arrow 66 parallel to which the head 12 ideally moves during the performance of a putt. The edge 64 is spaced from the center of the mark 51 a distance X that is approximately equal to the radius of a conventional golf ball 68, as viewed from overhead with the club 10 in the putting position. Accordingly, the edge 64 provides a frame for the golf ball 68 to facilitate alignment at setup with the golf ball 68 directly on the percussion center/horizontal center of the ball striking surface 34. As a further aid, preferably the mark 50 is formed as a line which is parallel to the putting line indicated by the arrow 66. The mark 50 can be painted onto the head 12 or ground therein for more permanence.

The diameter of the elongate shaft 14 at a location 70 beneath the grip 22 is preferably not more than 0.51 inches. The diameter of the elongate shaft 14 at the location 72, at the top edge 74 of the stub shaft 18 is preferably no more than 0.35 inches, and more preferably no more than 0.341 inches.

The foregoing disclosure of specific embodiments is intended to be illustrative of the broad concepts comprehended by the invention.

What is claimed is:

1. A club for putting a golf ball, said club comprising:

a head having a ground engaging surface and a ball striking surface; and an elongate shaft which is connected to the head and holdable by a user at a location remote from the head to permit manipulation of the head to perform a putt, wherein the ball striking surface extends upwardly from the ground engaging surface a predetermined distance, the predetermined distance being no more than 0.8 inches, wherein the elongate shaft has a frequency of no more than 275.

2. The club for putting a golf ball according to claim 1 wherein the head has a percussion center and the predetermined distance is measured at the percussion center.

3. The club for putting a golf ball according to claim 1 wherein the head has a toe and a heel and the predetermined distance is measured at a horizontal center substantially midway between the toe and heel.

4. The club for putting a golf ball according to claim 1 wherein the head comprises carbon steel.

5. The club for putting a golf ball according to claim 1 wherein the head has a body comprising a first material which defines a first part of the ball striking surface and there is a second material which defines a second part of the ball striking surface.

6. The club for putting a golf ball according to claim 5 wherein the second material comprises at least one of aluminum and copper.

7. The club for putting a golf ball according to claim 6 wherein the head has a percussion center and the second material defines the ball striking surface at the percussion center.

8. The club for putting a golf ball according to claim 1 wherein the club further comprises a grip attached to the elongate shaft, the grip has a top and bottom and the elongate shaft has a diameter adjacent the bottom of the grip that is not more than 0.51 inches.

9. The club for putting a golf ball according to claim 1 wherein the head connects to the elongate shaft at a first location and the elongate shaft has a diameter adjacent to the first location that is no more than 0.35 inches.

10. The club for putting a golf ball according to claim 1 wherein the head has a toe and a heel, a leading end defined by the ball striking surface and a trailing end and the ground engaging surface is convex between the toe and the heel.

11. The club for putting a golf ball according to claim 10 wherein the ground engaging surface is substantially flat between the leading end and trailing end of the head.

12. The club for puffing a golf ball according to claim 1 wherein the head has a toe and heel, a leading end defined by the ball striking surface and a trailing end, the head is moved in a forward direction in a putting line to cause the ball striking surface to contact and advance a golf ball, the head has a substantially straight edge projecting forwardly in the putting line from the ball striking surface, the head has a horizontal center substantially midway between the toe and heel, and a distance between the head edge and horizontal center, as viewed from above the head, is substantially equal to one-half the radius of a golf ball, whereby a user of the putter can, from a vantage point above the head, frame a golf ball being putted with the head edge to align a center of the golf ball with the horizontal center of the head.

13. The club for putting a golf ball according to claim 1 wherein the head has a toe and heel, a leading end defined by the ball striking surface and a trailing end, the head is moved in a forward direction in a putting line to cause the ball striking surface to contact and advance a golf ball, the head has a substantially straight edge projecting forwardly in the putting line from the ball striking surface, the head has a percussion center and a distance between the head edge and horizontal center, as viewed from above the head, is substantially equal to one-half the radius of a golf ball, whereby a user of the putter can, from a vantage point above the head, frame a golf ball being putted with the head edge to align a center of the golf ball with the percussion center of the head.

14. The club for putting a golf ball according to claim 1 wherein the club has a shaft angle of approximately 0°.

15. The club for putting a golf ball according to claim 1 wherein the head has a loft that is greater than 0°.

16. A club for putting a golf ball, said club comprising:

a head having a ground engaging surface and a ball striking surface; and an elongate shaft which is connected to the head and holdable by a user at a location remote from the head to permit manipulation of the head to perform a putt, wherein the ball striking surface extends upwardly from the ground engaging surface a predetermined distance, the predetermined distance being no more than 0.8 inches, wherein the head has a percussion center and the predetermined distance is measured at the percussion center.

17. A club head for putting a golf ball, said club head comprising:

a body with a ground engaging surface and a ball striking surface, wherein the ball striking surface extends upwardly from the ground engaging surface a predetermined distance, the predetermined distance being no more than 0.8 inches.

18. The club head according to claim 17 wherein the head has a heel and toe and the predetermined distance is measured at a horizontal center substantially midway between the toe and heel.

19. The club head according to claim 17 wherein the head has a percussion center and the predetermined distance is measured at the percussion center.

20. The club head according to claim 19 wherein the head has a visible mark thereon to locate the percussion center for a user.

* * * * *